US005657365A

United States Patent [19]

Yamamoto et al.

[11] Patent Number: 5,657,365

[45] Date of Patent: Aug. 12, 1997

[54] X-RAY GENERATION APPARATUS

[75] Inventors: Yoshiyuki Yamamoto; Keiichiro Tanabe; Naoji Fujimori; Nobuhiro Ota, all of Itami, Japan

[73] Assignee: Sumitomo Electric Industries, Ltd., Osaka, Japan

[21] Appl. No.: 515,096

[22] Filed: Aug. 14, 1995

[30] Foreign Application Priority Data

Aug. 20, 1994 [JP] Japan ..... 6-218074
May 22, 1995 [JP] Japan ..... 7-148081

[51] Int. Cl.[6] ..... H05G 1/00

[52] U.S. Cl. ..... 378/143; 378/141; 378/121

[58] Field of Search ..... 378/119, 143, 378/144, 124, 125, 127, 128, 129, 130, 121, 141

[56] References Cited

U.S. PATENT DOCUMENTS

| | | | |
|---|---|---|---|
| 1,279,423 | 9/1918 | Pfanstiehl | 378/143 |
| 3,329,847 | 7/1967 | Friedman | 313/60 |
| 3,992,633 | 11/1976 | Braun | 250/503 |
| 4,266,138 | 5/1981 | Nelson, Jr. et al. | 378/143 X |
| 4,323,780 | 4/1982 | Tombaugh et al. | 378/143 |
| 4,847,883 | 7/1989 | Fourre | 378/143 X |
| 5,065,419 | 11/1991 | Leguen et al. | 378/143 X |
| 5,148,462 | 9/1992 | Spitsyn | 378/143 |
| 5,420,906 | 5/1995 | Smit et al. | 378/143 X |

FOREIGN PATENT DOCUMENTS

| | | |
|---|---|---|
| 0432568A2 | 6/1991 | European Pat. Off. . |
| 2358512 | 6/1975 | Germany . |
| 57-38548 | 3/1982 | Japan . |
| 57-038548 | 6/1982 | Japan . |
| 2-267844 | 11/1990 | Japan . |
| 2-309596 | 12/1990 | Japan . |
| 3-274001 | 12/1991 | Japan . |
| 5-343193 | 12/1993 | Japan . |
| 52-99355 | 2/1994 | Japan . |
| 6-036718 | 2/1994 | Japan . |

*Primary Examiner*—David P. Porta
*Attorney, Agent, or Firm*—Beveridge, DeGrandi, Weilacher & Young, L.L.P.

[57] ABSTRACT

An X-ray generation apparatus has an anticathode which includes a high thermal conductive substrate and a target of generating X-ray by irradiation of electron. The target penetrates the high heat conductive substrate. Improved cooling efficiency and durability of the anticathode is obtained as well as miniaturization and simplification of the X-ray generation apparatus is achieved.

12 Claims, 3 Drawing Sheets

X-RAY GENERATION APPARATUS

BACKGROUND OF THE INVENTION

1. Field of the Invention

The present invention relates to an X-ray generation apparatus, specifically, one which makes it possible to generate high X-ray output by use of a smaller apparatus than the conventional size.

The ordinary method, which generates X-ray using irradiation of accelerated electrons to a target, adapted an X-ray generation apparatus. However, when electrons, which are accelerated by some tens of thousands voltage, collide with the target, only 1% of the accelerated electron energy changes to X-ray energy and the remaining 99% is consumed by Joule's heat. It is essential to investigate how to effectively radiate one hundred times the thermal energy incidental to X-ray generation from the target, in order to obtain a high output X-ray generation apparatus. The range of X-ray strength generated by an apparatus depends on the target material and cooling ability. The generated X-ray energy can be increased by increasing electron irradiation energy within a range of the target not melted by irradiation of accelerated electrons.

Therefore, metal materials which have high thermal conductivity and high melting temperature are mainly used as the X-ray target, and the thermal energy is radiated by water cooling. Furthermore, in order to obtain high strength X-rays, a method by which the target is cooled while rotating has been developed. In this method, a portion of the target which is irradiated by electrons and emits X-rays, rotates one after another, the temperature of the target does not increase, and higher X-ray energy can be obtained compared with a fixed type target.

2. Description of the Prior Art

A diamond containing target, in which the diamond is embedded in a copper substrate by powder sintering, is used and the target is cooled and rotated in an X-ray generation apparatus shown in Tokkai-Sho 57 (1982)-38548. However, it has been pointed out that as the size of such X-ray apparatus increases, it is imperative to prevent vibration when rotating the target. Furthermore, there are problems with decreased efficiency of the electron beam when the electron beam irradiates both copper and diamond.

An X-ray generation apparatus, in which an electron beam irradiates in the direction of a heat resistant single crystal axis, emits X-rays in the direction of the single crystal axis and a cooling means of the single crystal is prepared, as shown in Tokkai-Hei 2 (1990)-309596. However, there are arguments that the target is cooled insufficiently because the electron irradiating portion of the target is cooled through the peripheral portion of the single crystal.

An anticathode for X-ray generation which is made from a 2-layer structure of high heat conductive inorganic material and thin metal film, is shown in Tokkai-Hei 5 (1993)-343193. Effective cooling is expected when the back portion of the high heat conductive inorganic material is cooled as shown in this prior art. However, when the target is adapted for an X-ray generation apparatus and is cooled at the peripheral portion (as shown in Tokkai-Hei 2-309596), the target does not have sufficient cooling ability because a considerable amount of thermal energy diffuses along the thin metal film for which heat conduction is rather high. The other problem is exfoliation of the thin metal film. A method of synthesizing diamond from the gaseous phase is disclosed in U.S. Pat. No. 4,767,608 issued Aug. 30, 1988, and in U.S. Pat. No. 4,434,188 issued Feb 28, 1994.

SUMMARY OF THE INVENTION

Responding to the controversy, the inventors have significantly improved the cooling efficiency and durability of the anticathode, miniaturized and simplified the X-ray generation apparatus, and have finally completed this high output and high strength X-ray generation apparatus invention. More particularly, there is described an X-ray generation apparatus having an anticathode in which a target is arranged to penetrate a high heat conductive substrate. The target emits X-rays when irradiated by electrons.

Since thermal conductivity of the high heat conductive substrate of at least 10 W/cm·k is preferable, a diamond is favored because it has high thermal conductivity and stability at high temperature. A natural single crystal diamond, a single crystal diamond synthesized under high pressure and a polycrystalline diamond synthesized by chemical vapor deposition can be used as a high heat conductive substrate. A desired shape and comparatively large diamond can be obtained by the chemical vapor deposition. A cubic boron nitride crystal can be used as another suitable material.

A material having the desired wave length of characteristic X-rays can be used as a target material, therefore, for example, Mo, W, Cu, Ag, Ni, Co, Cr, Fe, Ti, Rh or an alloy of the above elements can be used.

Furthermore, to uniformly radiate the thermal energy generated at the target, it is preferable that the high heat conductive material is a disk and the target is arranged at the center of the substrate to penetrate the substrate.

One object of this invention is to provide an X-ray generation apparatus having an anticathode for X-ray generation in which a target is arranged to penetrate a high heat conductive substrate.

Another object of this invention is to provide a high heat conductive substrate having at least one groove in the substrate to pass a coolant.

Another goal of this invention is to provide a composite of a high heat conductive material arranged on a supporting material and having a groove in the side of the high heat conductive material of the intermediate surface.

Additional objects of this invention are to provide a high heat anticonductive material with a metal film on one side of the material and to provide electrical resistance of a high heat conductive material of not more than $10^3\Omega\cdot$cm partially or wholly.

Said high heat conductive material is a diamond, preferably a gaseous phase synthesized diamond.

The portion of B-doped diamond which electrical resistance is not more than $10^3\Omega\cdot$cm is used.

DETAILED DESCRIPTION OF THE PREFERRED EMBODIMENTS

Figure 1:
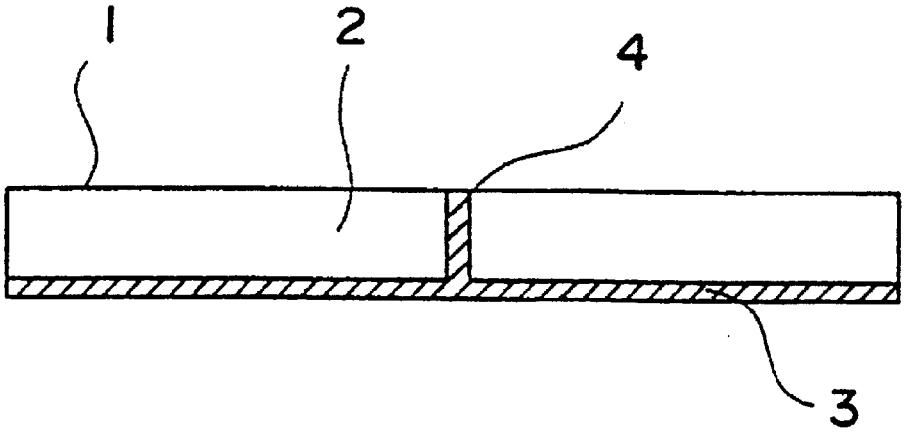
FIG. 1 shows schematic cross-sectional view of an anticathode in accordance with this invention.

Using the construction of this invention, X-ray output can be increased in any cooling system because the thermal energy generating at a target sufficiently radiates through the high heat conductive substrate. This construction demonstrates remarkable efficiency, especially in cooling the anticathode at the peripheral portion of the substrate. The high heat conductive material is arranged in the conduction direction of thermal energy in the present invention, cooling efficiency is remarkably improved compared with the conventional cathode plate, and consequently high X-ray output can be generated.

It is preferable that the substrate is as thick as possible from the viewpoint of cooling ability, however, excessive thickness is undesirable from the viewpoint of cost. The thickness of the substrate should range from 100 μm and to 10 mm, and preferably from 300 μm to 5 mm. Furthermore, when a high heat conductive substrate which has a groove to pass a coolant, is adapted to an X-ray generation apparatus, the apparatus obtains high cooling efficiency simply with a cooling system to flow a coolant. As a result, the X-ray generation apparatus generates high output and high strength X-rays.

Furthermore, when a high heat conductive substrate which has a groove for conducting a coolant and is adhered with an appropriate supporting material, is adapted to an anticathode of an X-ray generation apparatus, the apparatus obtains high cooling efficiency simply with a cooling system to flow a coolant. As a result, the X-ray generation apparatus generates high output and high strength X-rays. When a groove is prepared in a substrate or at a substrate side between the substrate and a supporting material, the cross section of the groove is preferably rectangular. The deeper (c) the groove, the higher the heat exchange efficiency of the anticathode. However an excessive depth of the groove is undesirable because mechanical strength of the anticathode becomes weak. The depth of the groove (c) must not be smaller than 20 μm, and preferably not smaller than 50 μm. The depth of the groove should be smaller than 90% of the substrate thickness and preferably smaller than 80%. The width of the groove is broader and heat exchange efficiency of the anticathode passway is higher.

However, excessive width of the groove lowers heat exchange efficiency, because the number of pathways decreases to maintain mechanical strength of the substrate. On the other hand, excessive or insufficient width of the groove as well as the distance between the grooves (b) is undesirable. The width of the groove and the distance between the grooves should range from 20 μm to 10 mm, and preferably from 40 μm to 2 mm. The lower limit of the ratio (a/b) of the width (a) and the distance (b) is should be 0.02, and preferably 0.04. On the other hand the upper limit of the ratio should be 50, and preferably 25. The lower limit of the ratio (a/c) of the width (a) and the depth (c) is preferably 0.05 and more preferably 0.1. On the other hand, the upper limit of the ratio is preferably 100 and more preferably 50.

The most suitable width, distance and depth depend on the heat load and coolant pressure of the X-ray generation apparatus. The shape of the pathway can be not only rectangular but also semicircular, semielliptical and various complex shapes. Thus, the values for (a), (b) and (c) are not always uniform and are changeable within the above range in one anticathode. A ratio of (groove surface)/(substrate surface) of the front view of the substrate should range from 2~90% and more preferably in a range of 10~80%. An angle between the side surface of the groove and the line perpendicular to the substrate is preferably not larger than 30°.

A non-diamond carbon layer is useful at the surface of the groove in a thickness of 1 nm~1 μm. The non-diamond layer can bet formed in a non-oxidation atmosphere (for example in a non-active gas atmosphere) at a temperature of 1000°~1500° C. for 0.5~10 hours. Existence of the non-diamond layer is observed by the raman spectrum method. Excellent wetting of the surface to coolant is preferable. It is also preferable that the contact angle between the surface and the coolant is not larger than 65° and desirably not larger than 60°.

Since there are hydrogen atoms on the diamond surface, a diamond repels coolant such as water. Wetting of a diamond can be increased by changing the hydrogen atoms to hydrophilic group (for example OH) including an oxygen atom. To improve the wetting of a diamond, for example, a diamond is annealed in an oxidation atmosphere at temperatures of 500°~800° C. for 10 minutes~10 hours, or heated in a plasma of oxygen or gas which contains oxygen.

When oxygen plasma is used to make a groove, wetting of the groove is improved to some degree. The above means of improving wetting of the surface should be carried out after making a groove in the oxygen plasma.

When a fluoro-carbon is used as the coolant, it is preferable that a halogen atom such as a fluorine atom is combined with the surface of the groove. Such surface can be obtained by exposing the groove in a gas plasma, which contains a halogen atom such as $CF_4$. When the groove is exposed, for example, in RF plasma of $CF_4$, hydrogen atoms on the surface are changed to fluorine atoms.

It is defined that the fluorine atom combines with carbon atoms of the surface by XPS (X-ray photoelectron spectroscopy) spectrum observation. The XPS spectrum has a single peak of $C_{1S}$ before the exposure but has many satellites of $CF_n$ radicals after the exposure.

Such surface has good wettability to fluorine compounds. Other treatments expose the surface to gas plasma which contains nitrogen, boron and inert gas atoms. Water, air, inert gas such as nitrogen and argon, fluoro-carbon, liquid nitrogen, liquid oxygen and liquid helium can be used as a coolant.

Groove or a tube methods are explained hereunder wherein a tube is formed in the interior of a substrate and a groove is formed on a substrate interface between the substrate and a supporting material. The tube method is explained first.

A tube is formed in a substrate by laser machining as a pathway for the coolant. A desired shaped plate made of a high heat conductive material is provided wherein a tube is made by collecting a laser beam at the side of the material. This tube forms a pathway through which the coolant flows.

Another method of making a tube is to adhere the first high heat conductive material having a groove to the second high heat conductive material. A high heat conductive material is worked into a desired shape. A groove is formed on one side of the first high heat conductive material by laser beam machining or selective etching. The laser beam machining removes material by collecting a laser beam at the surface of the material and a groove is made at the surface. An optional groove can be obtained by this method. A groove is made on the surface of the substrate by collecting a laser beam of sufficient energy density on the surface of the high heat conductive material, and gradually moving the collected portion. A YAG laser, Excimer laser can be used for this machining. Excimer lasers are preferable in view of optional depth, accuracy and repeatability of machining.

The wave length of the laser beam is preferred to range between 190~360 nm. Energy density of the laser beam should range between $10\sim10^{11}W/cm^2$.

Energy density of one pulse should range between $10^{-1}J/cm^2\sim10^6J/cm^2$, when using a pulse laser. Furthermore, the divergence angle of the laser beam from the generator is in a range of $10^{-2}\sim5\times10^{-1}$ mrad and full width at half maximum of laser spectrum wave length is in a range of $10^{-4}\sim1$ nm. Uniformity of energy distribution at the cross section of the laser beam should not be more than 10%. When pulse laser is collected by a cylindrical lens or a cylindrical mirror, good machining is obtained.

A groove is formed by the etching method described below. After adequate masking is formed on the surface of the high heat conductive material, the etching condition is selected so that only the material and not the masking is etched. When removing the masking, the first high heat conductive material having the groove on the surface is obtained. It is known that a diamond surface masked by Al or $SiO_2$ is selectively etched by oxygen or oxygen containing gas; see Extended Abstract vol. 2 (The 53rd Autumn Meeting 1992); The Japan Society of Applied Physics. Using this technique, a groove is formed on the diamond. Nitrogen or hydrogen can be a substitute for oxygen or oxygen containing gas.

The first high heat conductive material having desired grooves is adhered to the second high heat conductive material, and then a substrate of extremely high heat irradiation efficiency is obtained. An exit and entrance of coolant can be formed on the second high heat conductive material. The groove is formed only on the first high heat conductive material in the above example, however, it is possible that the surface of the second high heat conductive material having a groove is adhered to the surface of the first high heat conductive material having a groove. But the process becomes complicated, and it is preferable that the groove is formed only on the first high heat conductive material.

The adherence of the first high heat conductive material to the second high heat conductive material can be carried out by metalizing or adhering. It is possible for both of the two surfaces to be metalized by a prior technique, and then melting the metal to adhere. Metals such as Ti, Pt, Au, Sn, Pb, In and Ag are used for metalizing. For the adhesive (for example Ag/epoxi-group, Ag/polyimmide-group and Au/epoxi-group), Ag-brazing material and other adhesives can be used. The thickness of the adhesive is in a range of 0.01~10 μm.

When CVD diamond is used as the first high heat conductive material, the groove is made by not only laser beam machining and etching but also selective growth by masking.

The selective growth method is described in Tokkai-Hei 1-104761 and Tokkai-Hei 1-123423. A masking material is arranged corresponding to the desired groove on a base such as Si, SiC, Cu, Mo, CBN, on which diamond is synthesized.

In this case, when diamond is synthesized in more than 50 μm thickness, diamond is grown even on the mask portion and as a result diamond entirely covers the base. The base is then removed by means such as a dissolution method, and the obtained diamond has a groove on the base side. Ti, $SiO_2$ and Mo are formed on the base as a mask by a known method. The advantage of this method is that breakage during machining rarely occurs because this method does not need shock or impact for machining.

Instead of forming a mask in the above method, it is possible for diamond to be synthesized on a base having a projection corresponding to the groove. After synthesizing diamond to the desired thickness, and then removing the base, free standing diamond having a groove on the plate side is obtained. Si, SiC, and Mo can be used as a base. To improve the above method, adhering can be omitted. A mask is formed on a free standing diamond, and diamond is synthesized on the free standing diamond and then the mask is removed. A substrate having a tube can be obtained. Heat conductive efficiency of a substrate is further improved because an adhesive is not used. All of the above methods are preferable for precisely forming micro grooves. The laser method is preferable for machining speed. The masking method is preferable for large grooves. The second high heat conductive material can be selected from B, Be, Al, Cu, Si, Ag, Ti, Fe, Ni, Mo, and W, their alloys and their compounds such as carbide and nitride as a supporting material.

Accompanied by improved cooling ability, high output X-rays can be obtained in minute width of line since the target is not damaged by narrower-than-usual electron beam focus and increasing load to the target. The target which penetrates the substrate is grounded from a backside surface of the anticathode (opposite side of electron irradiation surface) and contributes to stabilizing X-ray generation. To ground the target from a backside surface, it is preferable for a thin metal film to be deposited on the back surface of the anticathode.

Furthermore, when gaseous phase synthesized diamond is used as a high heat conductive material, it is easy to ground a target using electric conductive diamond as a substrate. The electric conductive diamond is arranged as a layer in the substrate or a whole substrate. The electric conductive diamond is synthesized by adding impurities in raw material gas. Such impurities are B, Al, Li, P, S and Se. Boron is preferable, because the addition of boron in diamond increases electric conductivity efficiently without prohibiting crystallization. The electric resistivity of the diamond is not more than $10^3\Omega\cdot cm$ and preferable not more than $10^2\Omega\cdot cm$.

In addition, when the direction of electron beam coincides with the penetration direction of the target, an electron beam reaches the inner portion of the target and absorption ratio of the electron beam increases. For this reason, this invention is more useful to increase X-ray output than the target having 2-layer structures of high heat conductive inorganic material and thin metal film.

As explained above, the output and stability of X-ray can be increased using the present invented X-ray generation apparatus. Also, the apparatus can make the width of the X-ray beam narrower, and produce more output compared to the conventional apparatus. Furthermore, since the above advantages are obtained without using a rotating anticathode target, the whole apparatus becomes a small and simple construction.

Therefore the apparatus can be made inexpensively. Furthermore, vibration accompanied by rotation is prevented.

These advantages make the invented apparatus possible to use in X-ray analyzed apparatus, X-ray deposition apparatus and such various X-ray apparatus.

The invention is now explained in the following examples.

EXAMPLE 1

A polycrystalline diamond substrate (heat conductivity 16.9 w/cm·k) of 10 mm diameter and 1 mm thickness was prepared by chemical vapor deposition method. A pore of 0.2 mm diameter penetrated at the center of the substrate (2) by laser beam. A target of copper was arranged in the pore and then copper was evaporated on the back surface of the substrate and an anticathode (1) as shown in FIG. 1 was prepared. FIG. 1 shows that thin film of copper (3) was uniformly deposited on the back surface of the diamond substrate, the filled portion (4) was constructed by filling up the penetrated pore with copper.

Figure 2:
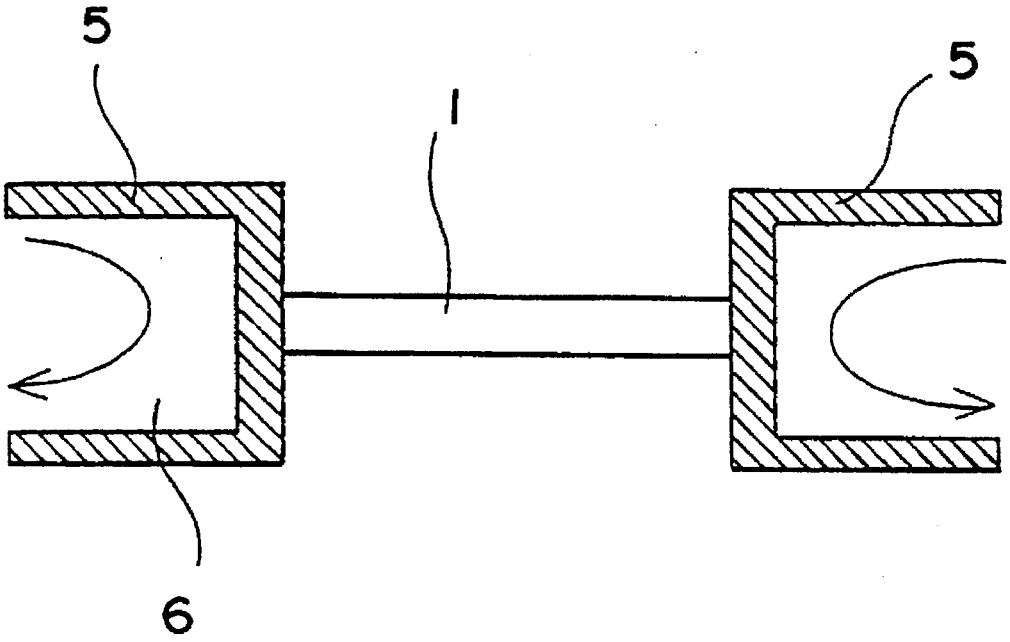
FIG. 2 shows a schematic view of an anticathode arranged on a holder.

Then, the anticathode was set at the cooling holder (5) as shown in FIG. 2. This holder (5) is ring shaped, the anticathode (1) was fixed at the central hole portion and cooling water (6) circulated in the outer peripheral portion. FIG. 2 was arranged to cool the cathode plate from the outer peripheral portion. It is considered that a specific means for setting the anticathode (1) is brazing, pinching and melting filled powder. The copper film (3) at the back surface of the substrate was grounded to prevent charging up of copper metal target.

Electron beam of 0.15 mm diameter continuously irradiated exposed metal copper at the filled portion (4) from the surface of the substrate by a load of 10 kw/mm$^2$. It was confirmed that the apparatus stably emitted X-rays after 1000 hours irradiation. The copper metal was examined after the test; there is no remarkable change in the surface condition.

The copper film was deposited on the back surface of the diamond target in this example, this copper film was not intrinsic.

EXAMPLE 2

Figure 3:
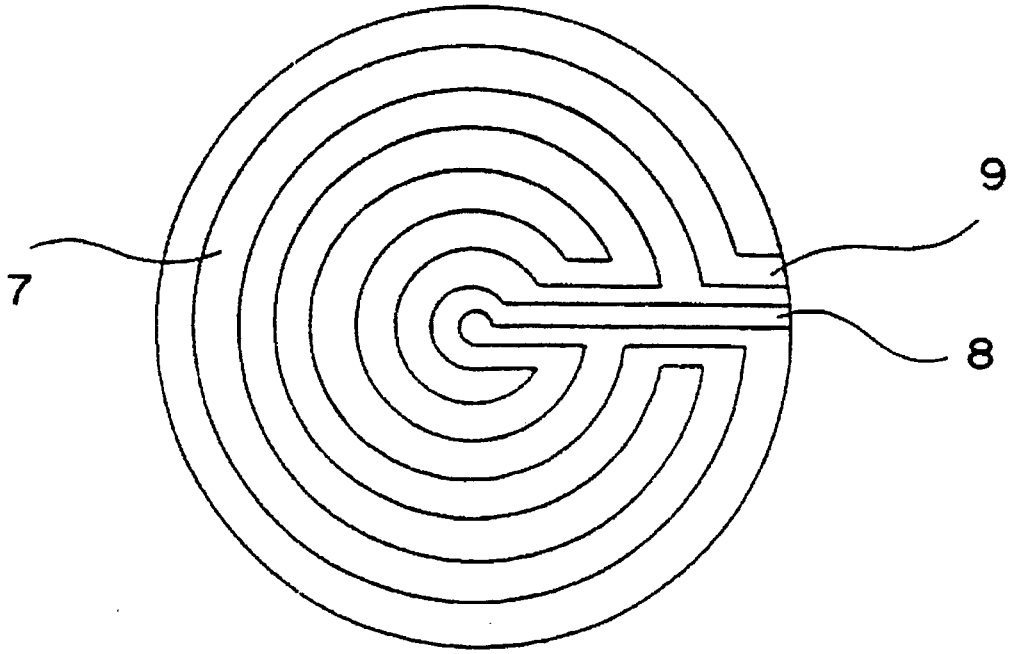
FIG. 3 shows the pattern of the groove to conduct a coolant.

Two scratched polycrystalline Si bases were prepared with a size of 10 mm diameter and 2 mm thickness. A diamond was synthesized on the Si base by micro-wave plasma-CVD method. Then the surface of the diamond was mechanically polished, and the Si base was dissolved by acid. The first diamond plate was of 10 mm diameter and 600 μm thickness. Heat conductivity was 17.9 w/cm·k. The second diamond plate was of 10 mm diameter and 400 μm thickness. Heat conductivity was 15.2 w/cm·k. These two diamond plates were free-standing. Grooves were formed on the surface of the first diamond plate as shown in FIG. 3 by KrF Excimer laser of lineal focus and point focus. A depth of the groove is about 100 μm, width of the groove is about 500 μm and the distance between the grooves is about 400 μm. Both of the diamond plates were coated in the order of Ti, Pt and Au by evaporation. Both of the coated surfaces were put together and then Au was melted to adhere the two diamond plates. The substrate was 10 mm diameter and 1 mm thickness and had a tube to pass a coolant.

Figure 4:
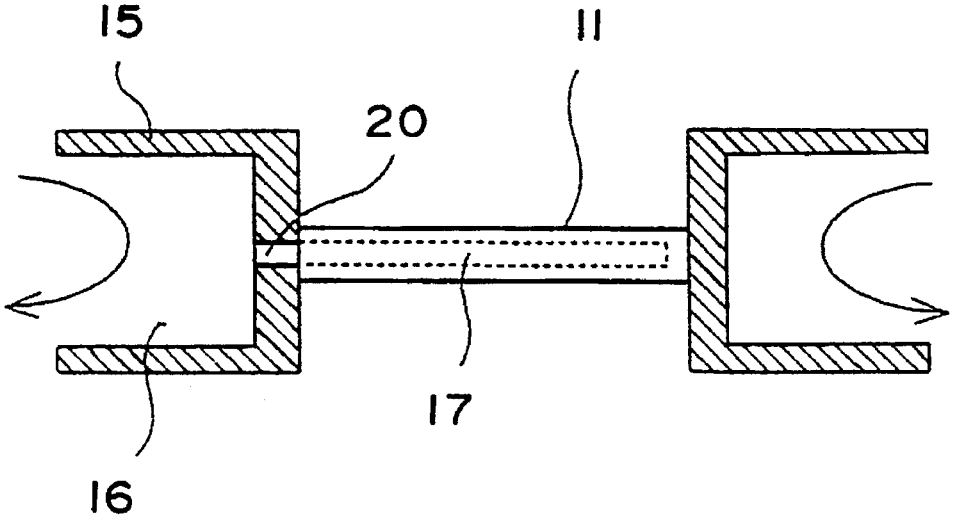
FIG. 4 shows a schematic view of an anticathode arranged in a holder, wherein the anticathode is composed of two adhered diamond plates and has a groove in it.
Figure 5:
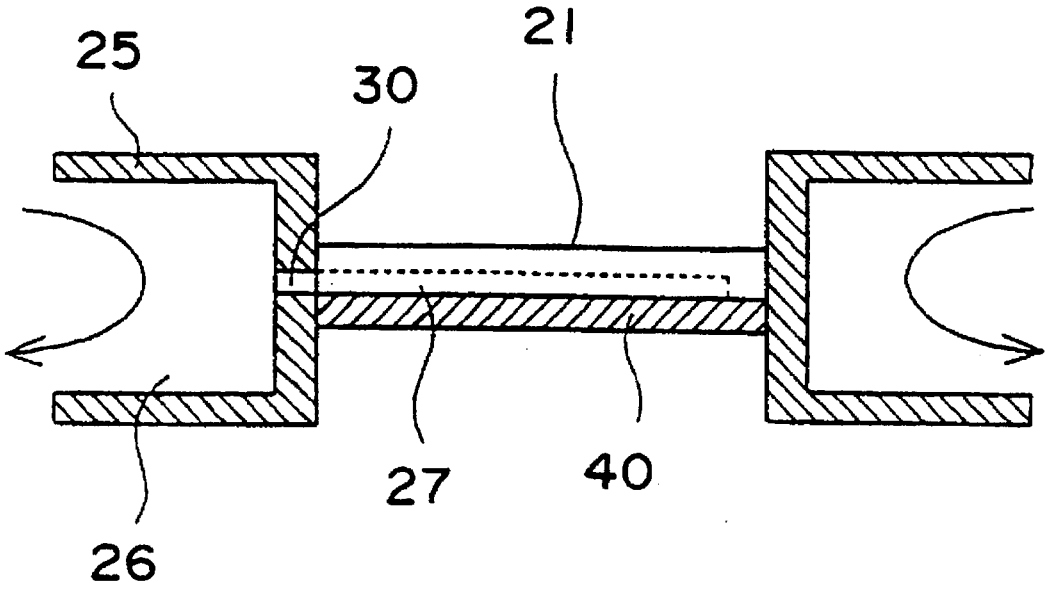
FIG. 5 shows a schematic view of an anticathode arranged in a holder, wherein the anticathode is composed of a diamond plate adhered to a supporting material and has a groove at the intermediate surface.

A penetrating hole was formed in the substrate, and then filled with copper as explained in Example 1. Then a substrate was prepared by coating Cu on one side. Then the substrate was set in a cooling holder (15) as shown in FIG. 4. This holder (15) was designed so that water, which cooled the substrate, was supplied from the side of the substrate. Cu coated surface was grounded to prevent the charging up of the copper target.

An X-ray generation apparatus which used the substrate, was tested under the same conditions as described in Example 1. Stability and durability are as excellent as Example 1.

EXAMPLE 3

A scratched polycrystalline Si base was prepared at a size of 10 mm diameter and 2 mm thickness. A diamond was synthesized on the Si base by micro-wave plasma CVD method. Then the surface of the diamond was mechanically polished, and the Si base was dissolved by acid. The diamond plate was 10 mm diameter and 1 mm thickness. Heat conductivity of the free-standing diamond plate was 17.3 w/cm·k. Grooves were formed on one side of the free-standing plate, as shown in FIG. 3, by K,F Exicimer laser of lineal focus and point focus. A depth of groove is about 300 μm, width of the groove is about 500 μm and the distance between the grooves is about 400 μm.

Figure 6:
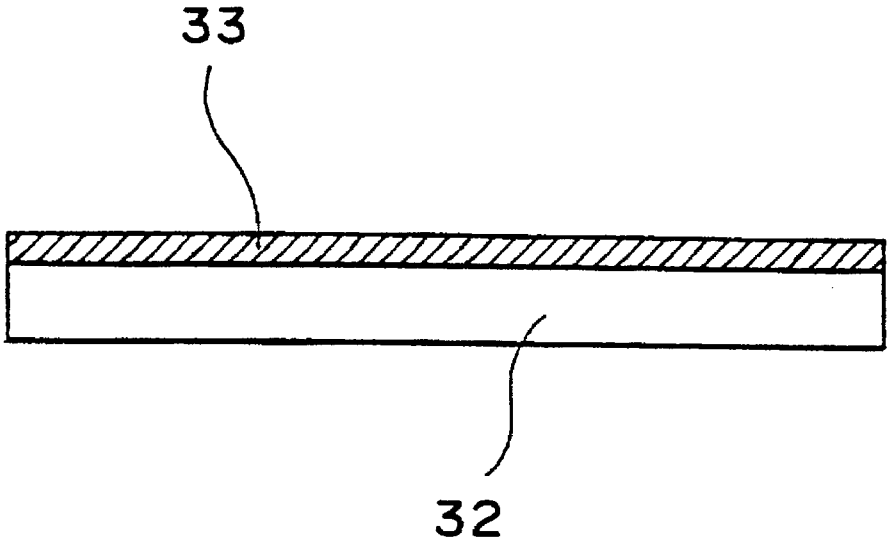
FIG. 6 shows a schematic cross-sectional view of a prior art anticathode.

A penetrating hole was formed in the free-standing substrate by laser beam, and then filled with copper as in Example 1. A Cu—W alloy plate was prepared at a size of 10 mm diameter for a supporting material. The surface of the diamond substrate having grooves was coated in the order of Ti, Pt and Au. One side of the Cu—W alloy plate was also coated in the order of Ti, Pt and Au. Both of the coated sides were adhered together by melting Au, and a substrate was obtained. Then the substrate was set in the cooling holder as shown in FIG. 6. This holder was designed so that water which cooled the substrate, was supplied from the side of the substrate.

An X-ray generation apparatus which used the substrate, was tested under the same conditions as described in Example 1. Stability and durability were as excellent as in Example 1.

EXAMPLE 4

A scratched polycrystalline Si base was prepared at a size of 10 mm diameter and 2 mm thickness. A diamond was synthesized on the Si base by micro-wave plasma CVD method. Then the surface of the diamond was mechanically polished, and the Si base was dissolved by acid. The diamond plate was 10 mm diameter and 1 mm thickness. Heat conductivity of the free-standing diamond plate was 17.3 w/cm·k. Because raw material gases contained B at the synthesizing diamond, electric resistance was 1.95Ω·cm.

A penetrating hole was formed in the free-standing diamond by laser beam, and then filled with copper as in Example 1. Then the substrate was set in the cooling holder. An X-ray generation apparatus which used the substrate, was tested under the same conditions as described in Example 1. Stability and durability were as excellent as Example 1.

COMPARATIVE EXAMPLE 1

A copper disk of 10 mm diameter and 1 mm thickness was set in the holder (5) as shown in FIG. 2.

The disk was continuously irradiated by an electron beam of 0.15 mm diameter and it was found that the X-rays did not generate in a stable way under a load of 4 kw/mm$^2$, and that the irradiated portion of the disk was considerably damaged by heat energy after 100 hours.

COMPARATIVE EXAMPLE 2

A polycrystalline diamond disk substrate (7) of 10 mm diameter and 1 mm thickness was prepared and copper was evaporated on one side of the disk as shown in FIG. 6. Then, the disk was set in the holder (5) as shown in FIG. 2.

Results of X-ray generation tests, which were carried out as Example 1 and comparative Example 1, showed that stable X-rays were obtained after 100 hours testing under a load of 4 kw/mm$^2$, and remarkable change was not recognized at the surface of the metal copper film. Under a load of 10 kw/mm$^2$, however, damage was observed and output of X-ray gradually decreased, at the irradiated portion of the metal copper film (8) after 500 hours irradiation.

Further variations and modifications of the foregoing will be apparent to those skilled in the art and are intended to be encompassed by the claims appended hereto.

Japanese priority applications 218074/1994 and 148081/1995 are relied on and incorporated herein by reference.

We claim:

1. An X-ray generation apparatus having an anticathode comprising:

a high thermal conductivity diamond substrate;

said diamond substrate having a hole penetrating said diamond substrate filled with target material;

said target material forming a target for generating X-rays by irradiation of electrons;

said target penetrating said diamond substrate;

said diamond substrate is synthesized using a gaseous phase method; and wherein said high thermal conductivity diamond substrate is provided with a dopant from a group consisting of B, Al, Li, P, S, Se, and alloys of these materials.

2. An X-ray generation apparatus according to claim 1, wherein said diamond substrate has at least one pathway to pass a coolant in said substrate.

3. An X-ray generation apparatus according to claim 1, further comprising:

a supporting material for mounting said diamond substrate; and a groove formed in said substrate adjacent said supporting material.

4. An X-ray generation apparatus according to claim 1, wherein said target is made from a metal selected from a group consisting of Mo, W, Cu, Ag, Ni, Co, Cr, Fe, Ti and Rh or an alloy thereof.

5. An X-ray generation apparatus according to claim 1, wherein said diamond substrate is coated with metal film on a side of said substrate.

6. An X-ray generation apparatus according to claim 1, wherein the electrical resistance of said diamond substrate is not more than $10^3\Omega\cdot$cm.

7. An X-ray generation apparatus according to claim 6, wherein said diamond substrate of not more than $10^3\Omega\cdot$cm. electrical resistance is a B-doped diamond synthesized from gaseous phase.

8. An X-ray generation apparatus having an anticathode comprising:

a high thermal conductivity diamond substrate;

a supporting material for mounting said diamond substrate;

a groove formed in said diamond substrate adjacent said supporting material;

said diamond substrate having a hole penetrating said diamond substrate filled with target material;

said target material forming a target for generating X-rays by irradiation of electrons;

said target penetrating said diamond substrate; and said diamond substrate is synthesized using a gaseous phase method.

9. An X-ray generation apparatus having an anticathode comprising:

a high thermal conductivity diamond substrate;

said diamond substrate having a hole penetrating said diamond substrate filled with target material;

said target material forming a target for generating X-rays by irradiation of electrons;

said target penetrating said diamond substrate;

said diamond substrate is synthesized using a gaseous phase method;

wherein the electrical resistance of said diamond substrate is not more that $10^5\Omega$cm; and wherein said diamond substrate of not more than $10^3\Omega$cm. electrical resistance is a B-doped diamond synthesized from gaseous phase.

10. An X-ray generation apparatus comprising:

a polycrystalline diamond substrate prepared by chemical vapor deposition having a hole penetrating the center of said substrate;

a copper target formed by filling said hole with copper;

a thin film of copper uniformly deposited on a back surface of said substrate forming an anticathode;

said anticathode positioned in a central hole portion of a cooling holder circulating cooling water at the periphery of said cooling holder; and said copper film is grounded.

11. An X-ray generation apparatus comprising:

a first diamond plate synthesized by micro-wave plasma-CVD method;

a second diamond plate synthesized by micro-wave plasma-CVD method;

said first diamond plate having a plurality of grooves;

a first titanium layer evaporated on said first diamond plate;

a first platinum layer evaporated upon said first titanium layer;

a first gold layer evaporated on said first platinum layer;

a second titanium layer evaporated on said second diamond plate;

a second platinum layer evaporated upon said second titanium layer;

a second gold layer evaporated said second platinum layer;

said first and second diamond plates having said first and second titanium, platinum, and gold layers melted together at said first and second gold layers to form a substrate;

said substrate having a hole penetrating said substrate;

a copper target filling said hole;

a copper coating on a side of said substrate for preventing charging of said target; and a cooling tube and a cooling holder for cooling said substrate.

12. An X-ray generation apparatus comprising:

a first diamond plate synthesized by micro-wave plasma-CVD method;

said first diamond plate having a plurality of grooves;

a first titanium layer evaporated on said first diamond plate;

a first platinum layer evaporated upon said first titanium layer of said first diamond plate;

a first gold layer evaporated on said first platinum layer of said first diamond plate;

a supporting plate prepared from a copper-tungsten alloy;

a second titanium layer evaporated on said supporting plate;

a second platinum layer evaporated on said second titanium layer;

a second gold layer evaporated said second platinum layer;

said supporting plate and said diamond plate having said first and second titanium, platinum, and gold layers melted together at said first and second gold layers to form a layered substrate;

said layered substrate having a hole penetrating said layered substrate;

a copper target formed from filling said hole with copper; and a cooling tube and a cooling holder for cooling said layered substrate.

* * * * *